US011077018B2

(12) United States Patent
Kwacz et al.

(10) Patent No.: US 11,077,018 B2
(45) Date of Patent: Aug. 3, 2021

(54) BATHING SYSTEM AND METHOD OF CONTROLLING SAME

(71) Applicant: Kohler Co., Kohler, WI (US)

(72) Inventors: Jason M. Kwacz, Kohler, WI (US); Madelynn Bouche, Oak Creek, WI (US)

(73) Assignee: KOHLER CO., Kohler, WI (US)

( * ) Notice: Subject to any disclaimer, the term of this patent is extended or adjusted under 35 U.S.C. 154(b) by 109 days.

(21) Appl. No.: 16/223,748

(22) Filed: Dec. 18, 2018

(65) Prior Publication Data

US 2019/0216681 A1 Jul. 18, 2019

Related U.S. Application Data

(60) Provisional application No. 62/616,878, filed on Jan. 12, 2018.

(51) Int. Cl.

| | |
|---|---|
| ***A61H 33/06*** | (2006.01) |
| ***A61H 33/00*** | (2006.01) |
| ***A61H 1/00*** | (2006.01) |

(52) U.S. Cl.

CPC ..... *A61H 33/065* (2013.01); *A61H 1/00* (2013.01); *A61H 33/601* (2013.01); *A61H 2033/068* (2013.01); *A61H 2201/5082* (2013.01)

(58) Field of Classification Search

CPC ..... A61H 33/065; A61H 33/601; A61H 1/00; A61H 2033/068; A61H 2201/5082

USPC ..... 4/524, 541.4, 541.5

See application file for complete search history.

(56) References Cited

U.S. PATENT DOCUMENTS

| | | | | |
|---|---|---|---|---|
| 433,490 | A | 8/1890 | Beilly | |
| 520,880 | A | 6/1894 | Gwynn | |
| 3,207,133 | A | 9/1965 | Andersen | |
| 3,417,747 | A | 12/1968 | Beger | |
| 3,571,818 | A | 3/1971 | Jacuzzi | |
| 3,842,446 | A | 10/1974 | Hunhausen et al. | |
| 4,008,498 | A | 2/1977 | Thomas | |
| 4,130,120 | A * | 12/1978 | Kohler, Jr. | A61H 33/06 607/80 |
| 4,249,522 | A | 2/1981 | Carrier | |
| 4,264,039 | A | 4/1981 | Moreland | |
| 4,754,502 | A | 7/1988 | Bowen | |
| 4,833,739 | A | 5/1989 | Sakakibara et al. | |

(Continued)

FOREIGN PATENT DOCUMENTS

| | | |
|---|---|---|
| CN | 203518235 | 4/2014 |
| CN | 106026909 | 10/2016 |

(Continued)

OTHER PUBLICATIONS

Chinese Second Office Action on CN Application No. 201810374929.9 dated Feb. 9, 2021.

*Primary Examiner* — Tuan N Nguyen

(74) *Attorney, Agent, or Firm* — Foley & Lardner LLP

(57) ABSTRACT

A bathing system includes a vessel, an air blower, and a steam generator. The vessel comprises an inlet. The air blower is fluidly coupled to the inlet by a conduit, and is configured to provide a flow of air to the conduit. The steam generator is fluidly coupled to the conduit upstream of the inlet, and is configured to provide steam to the conduit to create a mixture of steam and air in the conduit. The air blower is further configured to direct the mixture of steam and air to the vessel.

20 Claims, 8 Drawing Sheets

(56) References Cited

U.S. PATENT DOCUMENTS

| | | | | |
|---|---|---|---|---|
| 4,858,255 | A | 8/1989 | Haisman | |
| 4,859,345 | A | 8/1989 | Inagaki | |
| 4,899,401 | A | 2/1990 | Savarese | |
| 5,381,957 | A | 1/1995 | Bianco | |
| 5,930,851 | A | 8/1999 | Brunelle | |
| 6,317,903 | B1 | 11/2001 | Brunelle et al. | |
| 6,772,455 | B2 * | 8/2004 | Takahata | A61H 33/02 4/541.5 |
| 6,943,325 | B2 | 9/2005 | Pittman | |
| 7,334,274 | B2 | 2/2008 | Wang | |
| 7,775,457 | B2 | 8/2010 | Schnuckle | |
| 8,984,678 | B2 | 3/2015 | Brunelle et al. | |
| 9,410,652 | B2 | 8/2016 | Ellis et al. | |
| 9,487,350 | B2 | 11/2016 | Sivan et al. | |
| 2002/0050490 | A1 | 5/2002 | Pittman et al. | |
| 2008/0072375 | A1 | 3/2008 | Stewart | |
| 2008/0172783 | A1 | 7/2008 | Smith | |
| 2010/0223721 | A1 | 9/2010 | May et al. | |
| 2011/0283448 | A1 | 11/2011 | Kenoyer et al. | |
| 2013/0000031 | A1 | 1/2013 | Brunelle | |
| 2013/0305448 | A1 * | 11/2013 | Nguyen | A61H 33/067 4/533 |
| 2014/0059759 | A1 | 3/2014 | Duhack | |
| 2019/0099325 | A1 * | 4/2019 | Ovalle | A61H 33/005 |
| 2019/0254485 | A1 * | 8/2019 | Stout | A61H 33/0095 |

FOREIGN PATENT DOCUMENTS

| | | |
|---|---|---|
| JP | 04253861 | 9/1992 |
| RU | 2561292 | 8/2015 |

* cited by examiner

BATHING SYSTEM AND METHOD OF CONTROLLING SAME

CROSS-REFERENCE TO RELATED APPLICATIONS

This application claims the benefit of and priority to U.S. Provisional Application No. 62/616,878, filed Jan. 12, 2018, the entire disclosure of which is hereby incorporated by reference herein.

BACKGROUND

The present disclosure relates generally to the field of bathing systems. More specifically, this application relates to hydro-therapy bathing systems and methods of controlling the same.

SUMMARY

At least one embodiment of the present application relates to a bathing system including a vessel, an air blower, and a steam generator. The vessel comprises an inlet. The air blower is fluidly coupled to the inlet by a conduit, and is configured to provide a flow of air to the conduit. The steam generator is fluidly coupled to the conduit upstream of the inlet, and is configured to provide steam to the conduit to create a mixture of steam and air in the conduit. The air blower is further configured to direct the mixture of steam and air to the vessel.

Another embodiment relates to a bathing system including a bathtub, an air blower, and a steam generator. The bathtub comprises an inlet. The air blower is fluidly coupled to the inlet by a conduit, and is configured to provide a flow of air to the conduit. The steam generator is fluidly coupled to the conduit by a connector upstream of the inlet, and is configured to provide steam to the connector to create a mixture of steam and air at the connector. The air blower is further configured to direct the mixture of steam and air to the bathtub.

Yet another embodiment relates to a method of controlling a bathing system. The method comprises receiving, by a controller, a signal from a sensor that indicates a water level in a bathtub of the bathing system. The method further comprises providing, in response to the signal, a flow of air from an air blower to a conduit, wherein the conduit is coupled to an inlet of the bathtub. The method further comprises providing, in response to the signal, steam from a steam generator to the conduit to create a mixture of steam and air, wherein the steam generator is fluidly coupled to the conduit between the inlet and the air blower. The method further comprises directing, by the air blower, the mixture of steam and air to the bathtub.

In some exemplary embodiments, the bathing system further comprises a connector coupled to the conduit, wherein the connector fluidly couples the steam generator to the air blower upstream of the inlet. In some exemplary embodiments, the connector is a T-shaped connector. In some exemplary embodiments, the connector is a Y-shaped connector.

In some exemplary embodiments, the bathing system further comprises an air source fluidly coupled to the air blower upstream of the air blower, wherein the air source is configured to provide air to the air blower.

In some exemplary embodiments, the bathing system further comprises a water source fluidly coupled to the steam generator upstream of the steam generator, wherein the water source is configured to provide water to the steam generator.

In some exemplary embodiments, the mixture has an air to steam ratio of between about 1:1 to about 1:50.

In some exemplary embodiments, the bathing system further comprises at least one sensor disposed in the vessel, wherein the at least one sensor is configured to detect a water level in the vessel.

In some exemplary embodiments, the bathing system further comprises a controller coupled to the at least one sensor, wherein the controller is configured to control an amount of the mixture provided to the vessel in response to the signal received from the at least one sensor. In some exemplary embodiments, the controller is further configured to control an amount of air provided to the air blower in response to the signal received from the at least one sensor. In some exemplary embodiments, the controller is further configured to control an amount of water provided to the steam generator in response to the signal received from the at least one sensor.

In some exemplary embodiments, the bathing system further comprises a temperature sensor configured to measure a temperature of the mixture.

DETAILED DESCRIPTION

Figure 1:
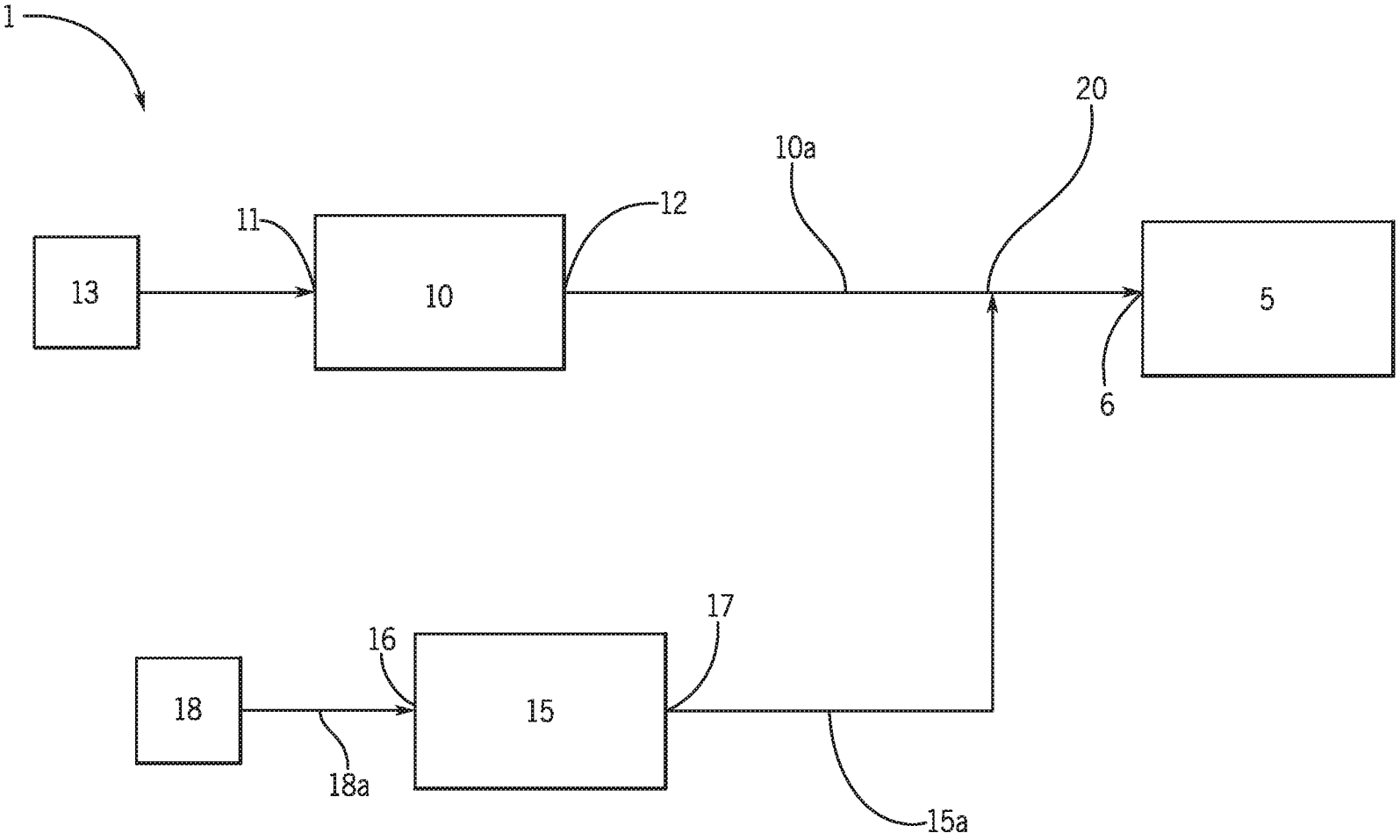
FIG. 1 is a schematic illustrating a bathing system according to one exemplary embodiment.

Conventional bathing systems typically suffer from water temperature decreases while a bather is taking a bath. These water temperature decreases can lead to discomfort for a bather. Water temperature decrease is particularly acute in bubble massage bathing systems, because introducing bubbles into the bath water increases the rate at which the water temperature decreases. Additionally, a bather may experience an uncomfortable coolness effect when the bather's body is immersed in the bath water, but in close proximity to an air injecting orifice that provides a bubble massaging function. The air provided by the orifice can cause a coolness effect on the bather's body.

Previous approaches to this problem of water temperature decrease have achieved reductions in the rate of temperature decreases, but have not been able to maintain a desired temperature in the bathing system as intended or as desired by the bather. For example, one possible approach to the problem is siphoning water from the tub, heating the water, and recirculating the heated water back into the tub, but this approach typically increases the complexity and cost of the bathing system.

Referring generally to the FIGURES, disclosed herein are systems for a hydro-therapy bathing system (e.g., a bubble massage bathing system) that introduce steam into the bathing system to increase the humidity in the air used to form bubbles in the bathing vessel, thereby helping to reduce or prevent rapid cooling of the water temperature as the air enters the bathing vessel. The steam and/or air/steam mixture provided to the bathing vessel enhances a bather's comfort and bathing experience by maintaining the temperature of the bath water within a temperature range consistent with a comfortable bathing experience by, for example, compensating for any temperature loss in the bath water attributable to the bubbles. The disclosed systems reduce or eliminate the coolness effect on the body of a bather immersed in hot water held within the bathing vessel (particularly when the bather may be located in the bathing vessel in close proximity to air injecting orifices which are located on a surface of the bathing vessel). These systems can maintain or even increase a temperature of water in the bathing vessel during the period of time the bather is using the bathing system. These systems are particularly effective when a temperature control system is included to regulate the temperature of the bath water.

Referring generally to the FIGURES, a bathing system 1 for a hydro-therapy bath includes a vessel 5, an air blower 10, a steam generator 15, and a connection point 20 for mixing air and steam to produce an air/steam mixture to provide to the vessel 5.

Referring further to the exemplary embodiment shown in FIG. 1, a system 1 for a hydro-therapy bath includes a vessel 5 (e.g., a bathtub, etc.) configured to hold a volume of water. The vessel 5 includes an inlet 6 configured to receive an air/steam mixture. The inlet 6 is positioned at a suitable location on the vessel 5; for example, the inlet 6 is positioned at a lower portion of a front end of the vessel 5. According to one aspect, the inlet 6 includes only one water inlet. According to another aspect, the inlet 6 includes more than one water inlet. For example, the inlet 6 includes two water inlets. As another example, the inlet 6 includes three water inlets. As yet another example, the inlet 6 includes four water inlets.

The system 1 also includes an air blower 10, which is fluidly coupled to the vessel 5 via a conduit (such as a pipe) 10*a*. According to one aspect, the air blower 10 includes an inlet 11 and an outlet 12. The air blower is configured to deliver air (e.g., by blowing air) into the vessel 5. The inlet 11 of the air blower 10 is fluidly coupled to an air source 13 (e.g., the ambient air, a pressurized air source, etc.) and is configured to provide air into the air blower 10. The outlet 12 of the air blower 10 is configured to expel air from the air blower 10 through a conduit (such as a pipe 10*a*) to the vessel 5, for example, through the inlet 6 of the vessel 5.

Figure 2:
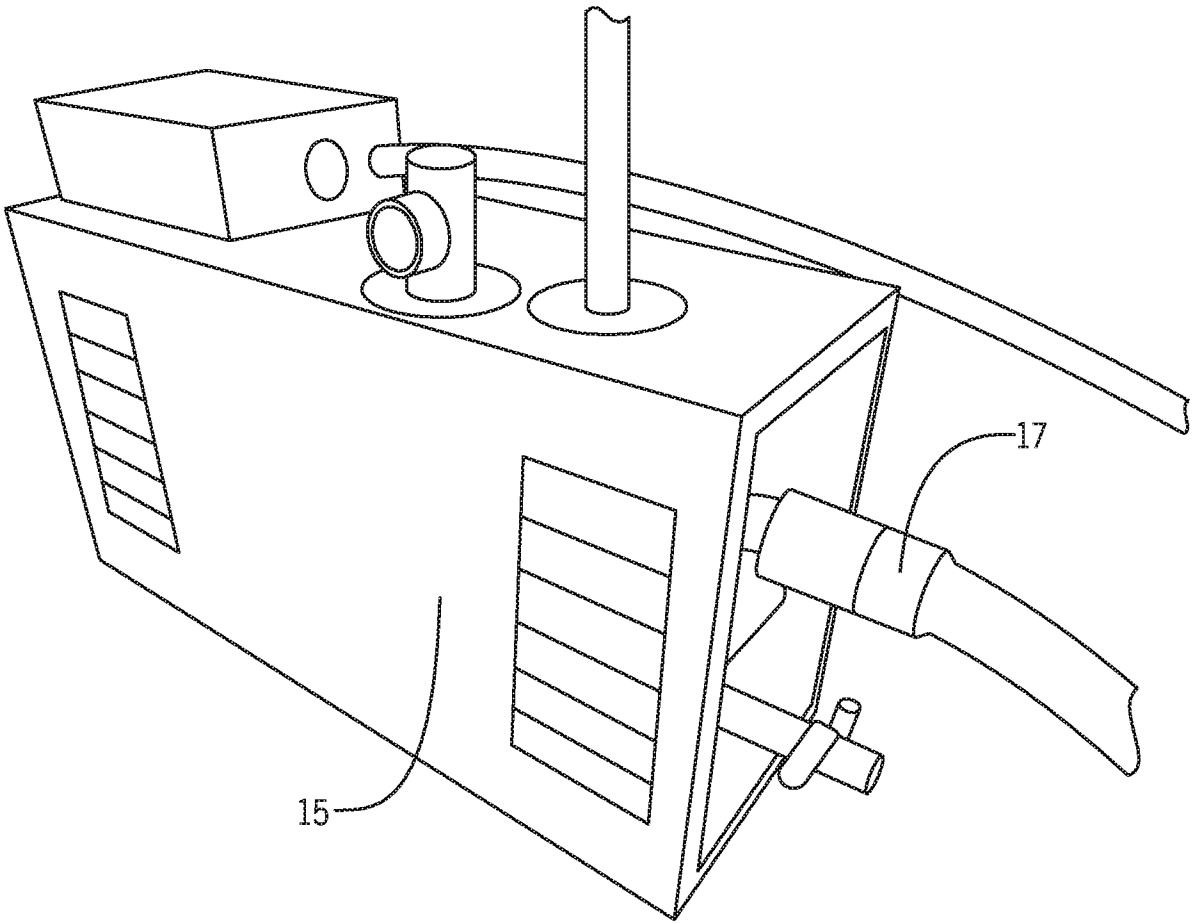
FIG. 2 illustrates a steam generator, according to the bathing system shown in FIG. 1.

The system 1 also includes a steam generator 15 including an inlet 16 and an outlet 17. According to one embodiment, the steam generator 15 is any commercially available device for generating steam. As a specific example, the steam generator 15 has a power output in a range from 1 kW to 5 kW. As another specific example, the steam generator 15 has a power output in a range from 2.5 kW to 3 kW. As another specific example, the steam generator 15 has a power output of 5 kW, such as the K-5525-NA 5 kW steam generator produced by Kohler®. The inlet 16 of the steam generator 15 is fluidly coupled to a water source 18 via a conduit (such as a water pipe) 18*a* and is configured to provide water (e.g., unheated water) to the steam generator 15. The steam generator 15 is configured to heat the water, thereby producing steam, which is expelled from the steam generator 15 through outlet 17, as shown in FIG. 2. Referring back to FIG. 1, the steam generator 15 is fluidly coupled downstream of the air blower 10 and upstream of the inlet 6 via a conduit 15*a* (e.g., a pipe) such that the air expelled from the outlet 12 of the air blower 10 mixes with the steam expelled from the outlet 17 of the steam generator 15 at a connection point 20.

Figure 3:
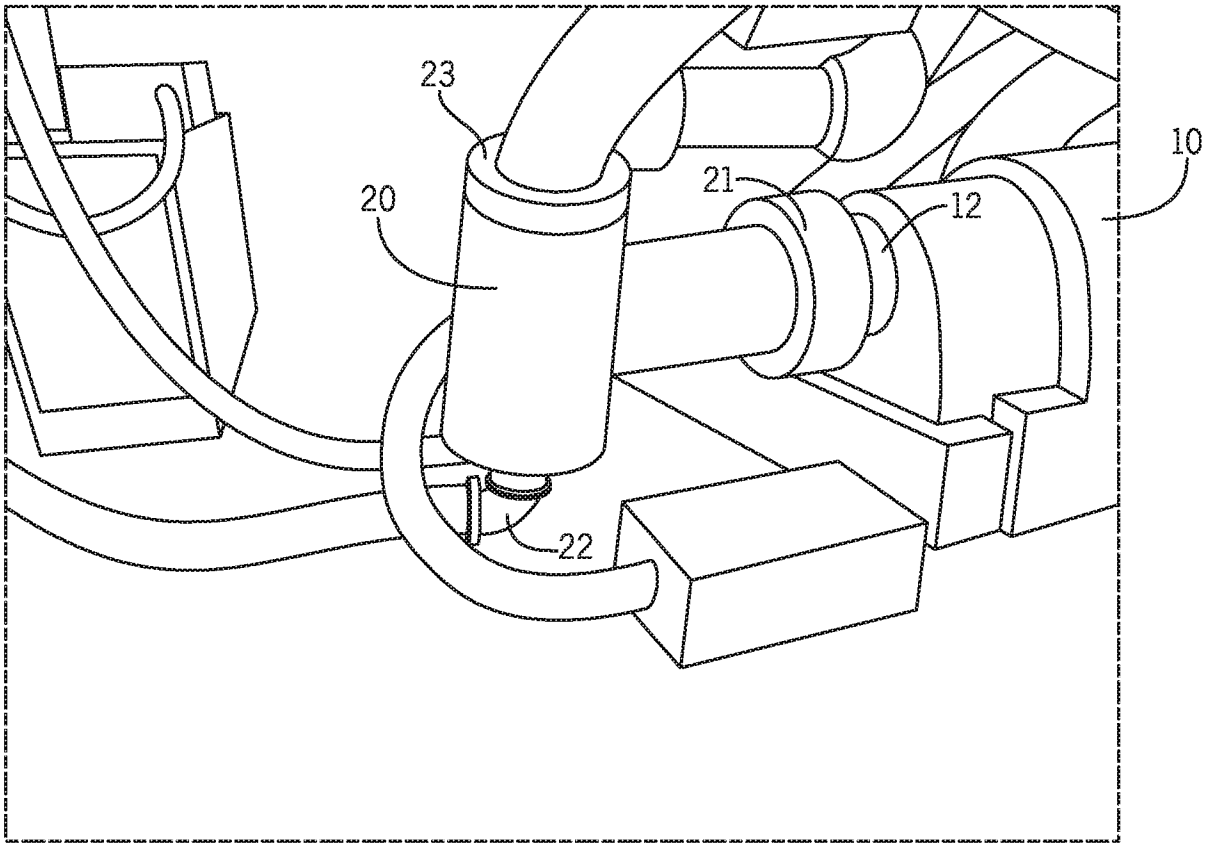
FIG. 3 illustrates a T-shaped connector connecting the steam generator and an air blower, according to one aspect of the bathing system shown in FIG. 1.

The connection point 20 is configured to facilitate a mixing of air and steam to produce an air/steam mixture which is delivered to the inlet 6 of the vessel 5. According to one aspect, the connection point 20 includes a T-shaped connector having a first inlet 21, a second inlet 22, and an outlet 23, as shown in FIG. 3. Referring to both FIG. 1 and FIG. 3, the first inlet 21 is fluidly coupled to the outlet 12 of the air blower 10, for example, via a conduit, for example an air pipe (such as portion of conduit 10*a*), and the second inlet 22 is fluidly coupled to the outlet 17 of the steam generator via a channel (e.g., a steam pipe). The outlet 23 is fluidly coupled to the inlet 6 of the vessel 5 via a channel (such as a pipe configured to receive an air/steam mixture). When air is provided from the air blower 10 and steam is provided from the steam generator 15, the air and steam mix at the connection point 20, thereby generating the air/steam mixture which is delivered to the inlet 6 of the vessel 5. A control system 700 (shown in FIG. 7 and described in more detail below) is configured to maintain a stable temperature of the air/steam mixture at the connection point 20 so that a temperature of the air/steam mixture is compatible with a comfortable bathing experience of a bather.

The ratio of air to steam in the air/steam mixture is any acceptably feasible ratio. For example, the ratio of air to steam in the air/steam mixture is in a range of between about one part air to about one part steam to about one part air to about fifty parts steam. As another example, the ratio of air to steam in the air/steam mixture is in a range of between about one part air to about one part steam to about one part air to about twenty-five parts steam. As another example, the ratio of air to steam in the air/steam mixture is in a range of between about one part air to about one part steam to about one part air to about ten parts steam. As a more specific example, the ratio of air to steam in the air/steam mixture is about one part air to about ten parts steam. As another specific example, the ratio of air to steam in the air/steam mixture is about one part air to about seven parts steam. As another specific example, the ratio of air to steam in the air/steam mixture is about one part air to about five parts steam.

According to one aspect, connection point 20 includes a T-shaped connector, as shown in FIG. 3. Although FIG. 3 shows a single connector, system 1 is not particularly limited to only a single connection point 20 or connector. For example, system 1 can include more than one connection point 20 or connector (e.g., T-shaped connector, Y-shaped connector, etc.). According to the aspect of system 1 shown in FIG. 3, the steam flow from the steam generator 15 meets and mixes with the air flow from the air blower 10 in the T-shaped connector. The steam enters a bottom end of the T-shaped connector, and air is blown into the T-shaped connector from the side. The combined air/steam mixture flows from the T-shaped connector and into at least one channel before entering a bathing vessel (e.g., a bath tub), such as the vessel 5. According to another aspect, the connection point 20 includes a Y-shaped connector. According to yet another aspect, the connection point 20 includes any suitable connector.

Figure 4:
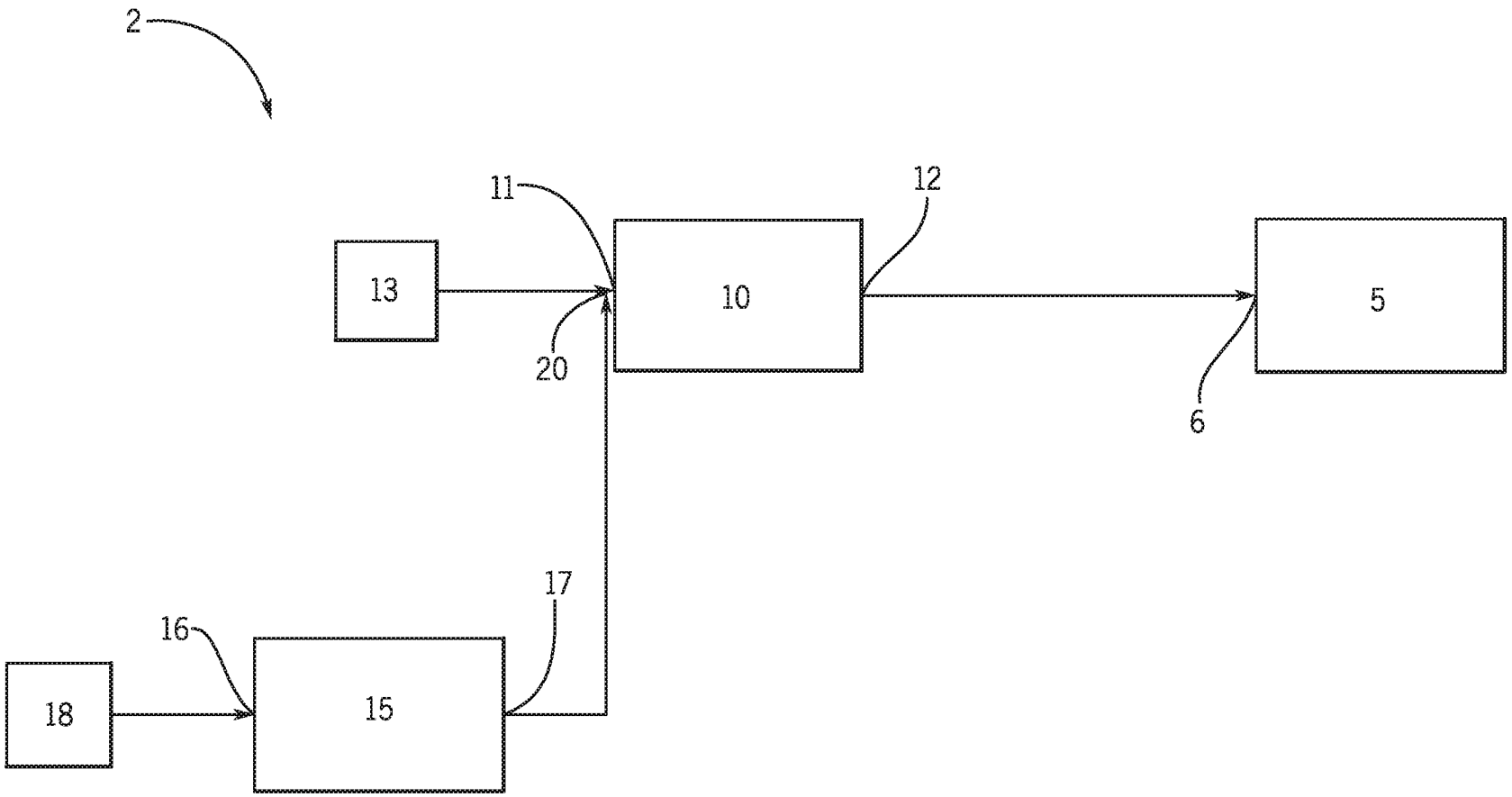
FIG. 4 is a schematic illustrating a bathing system, according to a second exemplary embodiment.

According to a second exemplary embodiment shown in FIG. 4, a system 2 for a hydro-therapy bath includes a vessel 5 (e.g., a bathtub, etc.) configured to hold a volume of water. The vessel 5 includes an inlet 6 configured to receive an air/steam mixture. The inlet 6 is positioned at a suitable location of the vessel 5; for example, the inlet 6 is positioned at a lower portion of a front end of the vessel 5.

System 2 also includes an air blower 10 fluidly coupled to the vessel 5. The air blower 10 includes an inlet 11 and an outlet 12. The inlet 11 of the air blower 10 is configured to receive air from an air source 13 (e.g., the ambient air, an external air source, etc.) and a steam flow produced by the steam generator 15. The air blower is thereby configured to receive the air and the steam flow and mix the air and the steam flow to produce an air/steam mixture which the air blower 10 provides to the inlet 6 of the vessel 5.

System 2 also includes a steam generator 15 which is fluidly coupled to air blower 10 and configured to provide a steam flow to the inlet 11 of the air blower 10. The steam generator 15 includes an inlet 16 and an outlet 17. The inlet 16 of the steam generator 15 is fluidly coupled to a water source 18 and is configured to deliver unheated water to the steam generator 15. The steam generator 15 is configured to heat the water provided through the inlet 16 to generate steam. The steam is expelled out of the steam generator 15 through the outlet 17. The steam then enters the air blower 10 through the inlet 11 of the air blower 10. The steam mixes with the air in the air blower 10 to produce an air/steam mixture. An appropriate amount of steam is delivered to the air blower to optimize performance or to achieve a predetermined ratio of air to steam in the air/steam mixture. For example, the appropriate amount of steam delivered to the air blower is an amount of steam that can achieve a ratio of air to steam in the air/steam mixture within a range of between about one part air to about one part steam to about one part air to about fifty parts steam. As another example, the appropriate amount of steam is an amount of steam that can achieve a ratio of air to steam within the air/steam mixture in a range of between about one part air to about one part steam to about one part air to about twenty-five parts steam. As another example, the appropriate amount of steam is an amount of steam that can achieve a ratio of air to steam in the air/steam mixture within a range of between about one part air to about one part steam to about one part air to about ten parts steam. As a more specific example, the appropriate amount of steam is an amount of steam that can achieve a ratio of air to steam in the air/steam mixture of about one part air to about seven parts steam.

Figure 5:
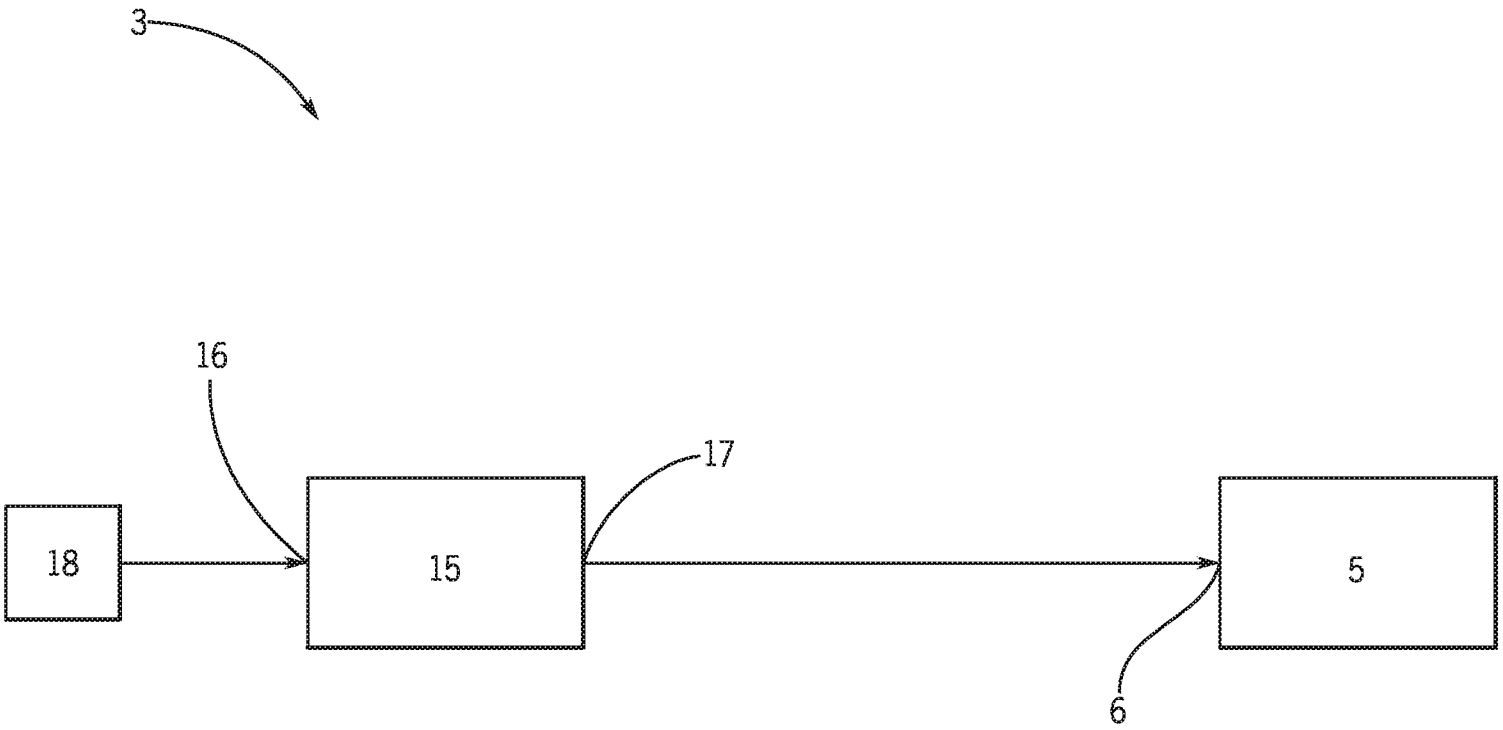
FIG. 5 is a schematic illustrating a bathing system, according to a third exemplary embodiment.

According to a third exemplary embodiment shown in FIG. 5, a system 3 for a hydro-therapy bath includes a vessel 5 (e.g., a bathtub, etc.) configured to hold a volume of water. The vessel 5 includes an inlet 6 configured to receive an air/steam mixture. The inlet 6 is positioned at a suitable location of the vessel 5; for example, the inlet 6 is positioned at a lower portion of a front end of the vessel 5.

The system 3 also includes a steam generator 15 fluidly coupled to the vessel 5. The steam generator 15 includes an inlet 16 and an outlet 17. The inlet 16 of the steam generator 15 is configured to receive water from a water source 18. The water from the water source 18 is, in one example, unheated and is delivered into the steam generator 15, which is configured to heat the water and produce steam. The steam produced by the steam generator 15 is expelled through the outlet 17 and is delivered directly to the inlet 6 of the vessel 5. Because it is advantageous to avoid introducing an excessive amount of steam into the vessel 5 through the inlet 6, the flow of steam is regulated such that an appropriate amount of steam is delivered to the vessel 5 without raising a temperature of the water in vessel 5 above a predetermined level.

Figure 6:
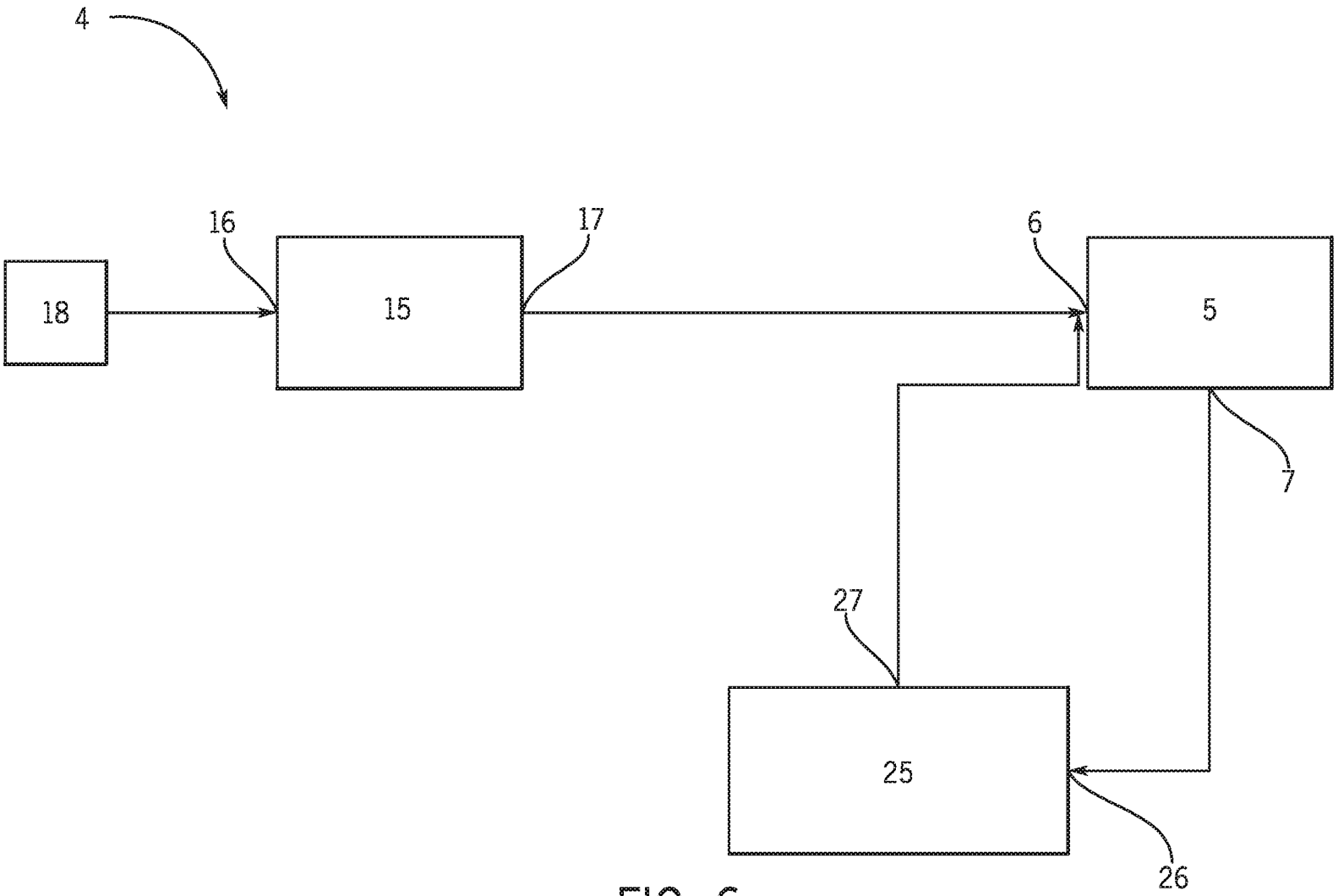
FIG. 6 is a schematic illustrating a bathing system, according to a fourth exemplary embodiment.

According to a fourth exemplary embodiment shown in FIG. 6, a system 4 for a hydro-therapy bath includes a vessel 5 (e.g., a bathtub, etc.) configured to hold a volume of water. The vessel 5 includes an inlet 6 configured to receive an air/steam mixture. The inlet 6 is positioned at a suitable location of the vessel 5; for example, the inlet 6 is positioned at a lower portion of a front end of the vessel 5. The vessel 5 also includes an outlet 7.

System 4 also includes a steam generator 15 fluidly coupled to the vessel 5. The steam generator 15 includes an inlet 16 and an outlet 17. The inlet 16 is fluidly coupled to a water source (not shown) such that unheated water is delivered into the steam generator 15 through the inlet 16. The steam generator 15 is configured to heat the water and produce steam. The steam is expelled through the outlet 17 and is delivered to the inlet 6 of the vessel 5.

The system 4 also includes a water pump 25 fluidly coupled to the vessel 5. The water pump 25 includes an inlet 26 receiving fluid from the outlet 7 of the vessel 5, and an outlet 27 directing the fluid to the steam line upstream of the inlet 6 of the vessel 5. The water pump 25 is configured to circulate a water flow in the system to cool a steam flow delivered to the vessel 5. The water pump 25 is configured to pump water out of the vessel 5, through the outlet 7 of the vessel 5 and into the inlet 26 of the water pump 25. The water pump 25 is further configured to pump water through the outlet 27 of the water pump 25 and into the steam line upstream of (or at) the inlet 6 of the vessel 5. The water which flows through the outlet 27 of the water pump 25 mixes with the steam provided from the steam generator 15, thereby cooling the steam expelled from the outlet 17 of the steam generator 15. Because the water pumped from the water pump 25 is approximately a same temperature as a temperature of the water in the vessel 5, the water pumped from the water pump 25 is at a cooler temperature than the steam. Thus, the water from the water pump 25 cools the steam prior to the delivery of the steam to the inlet 6 of the vessel 5. In this aspect, the inlet 6 is configured to delay the steam being delivered into the vessel 5. According to one aspect, a delay of about two seconds while the steam mixes with the water allows the steam to cool sufficiently before introducing the steam into vessel 5.

Figure 7:
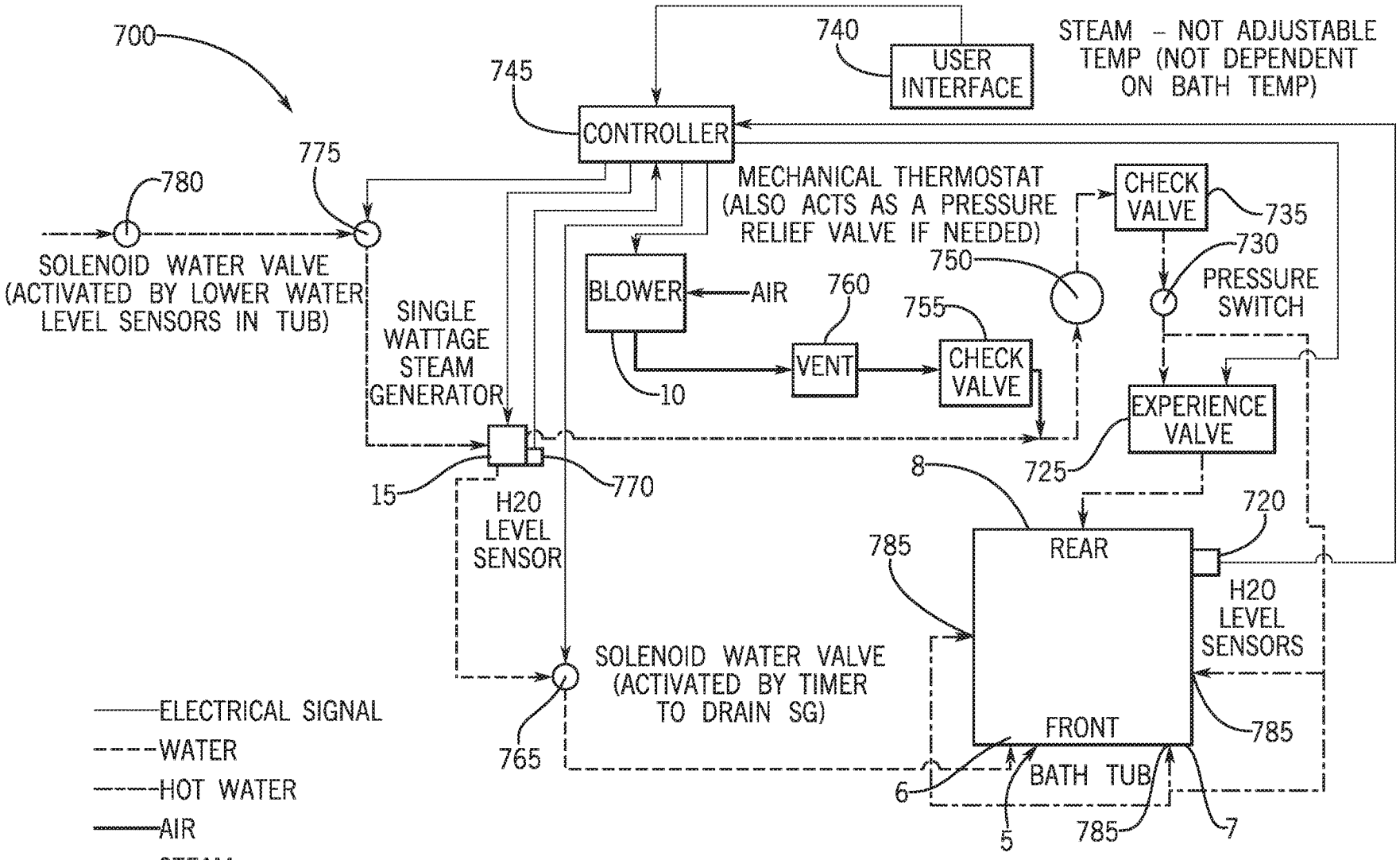
FIG. 7 is a control diagram illustrating a control system for the bathing systems shown in FIGS. 1-6.

FIG. 7 shows a control system 700 for the various embodiments of a hydro-therapy bathing system herein disclosed and described. The control system 700 is configured to control a hydro-therapy bathing system (such as system 1, system 2, system 3, or system 4 herein disclosed and described). At least one water level sensor 720 is disposed in the vessel 5 and is configured to detect a water level in the vessel 5 and configured to send signals to a controller 745. The controller 745 is electrically connected to a user interface 740 that is configured to receive user inputs.

The control system 700 is also configured to control the air blower 10 connected to an air source (not shown), such as the ambient air. The air blower 10 is fluidly connected to the vessel 5, and the air blower 10 is electrically connected to the controller 745. The air blower 10 is configured to blow air from the air source into the vessel 5, either directly or indirectly, by generating an airflow which flows from an outlet of the air blower 10 to the vessel 5.

The control system 700 is also further configured to control the steam generator 15, which is fluidly connected to the air blower 10 and includes a water level sensor 770 configured to detect a water level in the steam generator 15 and also configured to send and receive signals to the controller 745. The steam generator 15 is configured to heat water into steam and deliver the steam to the airflow produced by the air blower 10 and delivered to the vessel 5. The steam generator 15 is fluidly connected to a valve 775 (e.g., a solenoid water valve) and is in electrical connection with the controller 745. The valve 775 is configured to be activated by a signal sent by the controller 745 indicating a lower water level in the vessel 5 and thereby allow water to flow to the steam generator 15. In one aspect, the valve 775 is fluidly connected to a check valve 780, which is in turn connected to a water source (not shown).

The air blower 10 is fluidly connected to a vent 760 and a check valve 755. At the outlet of the check valve 755, the steam generated by the steam generator 15 flows into and joins the air flow created by the air blower 10. The control system 700 further includes a temperature sensor, shown as mechanical thermometer 750 in FIG. 7, which is configured to receive and measure a temperature of the combined mixture of steam and air flow. The mechanical thermometer 750 is further configured to act as a pressure relief valve to relieve excessive pressure build-up in either the air blower 10 or the steam generator 15. The mechanical thermometer 750 is fluidly connected to a check valve 735 which is configured to deliver the steam and air flow mix to a pressure switch 730. The pressure switch 730 is fluidly connected to a valve 725 and to the vessel 5. For example, the pressure switch 730 is fluidly connected to the vessel 5 at a plurality of points 785. The valve 725 is fluidly connected to the vessel 5 and is electrically connected to the controller 745. The valve 725 is configured to control the flow of the steam and air flow mix to the vessel 5.

Figure 8:
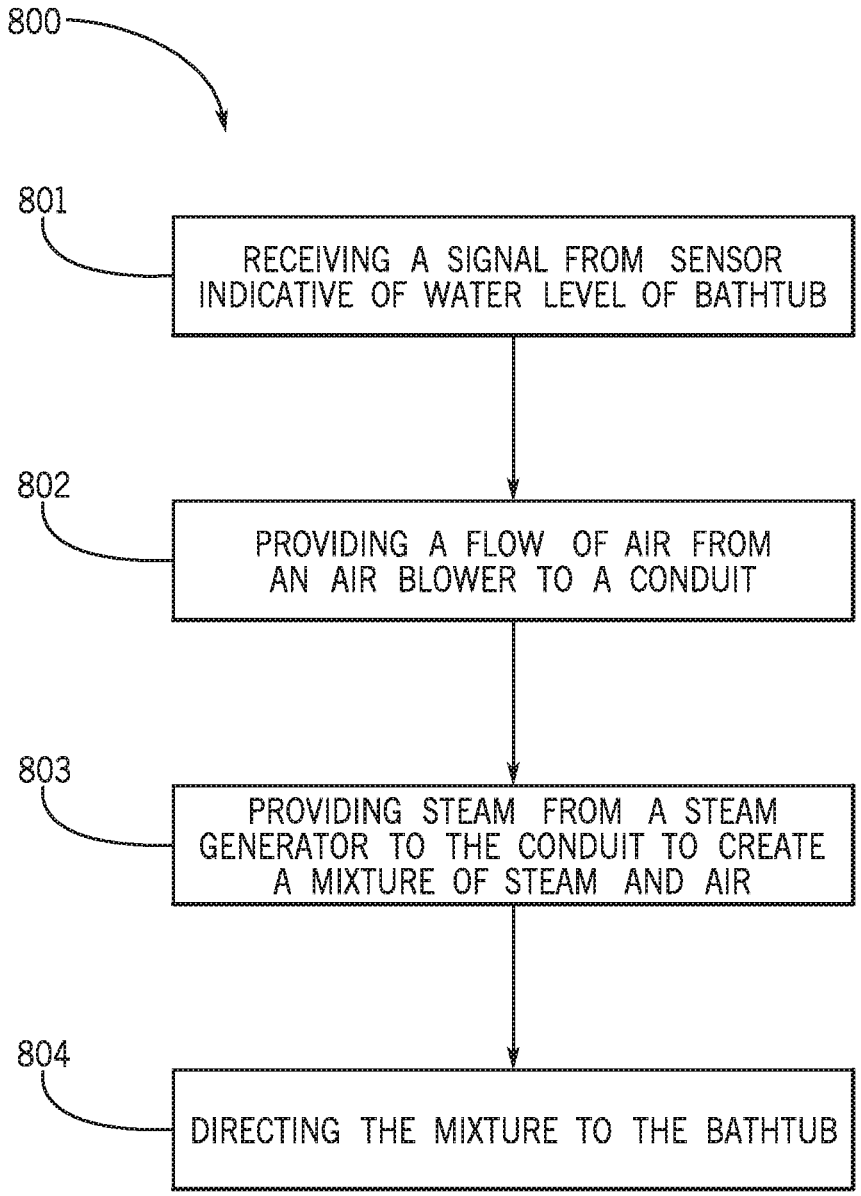
FIG. 8 is a flow chart illustrating a method of controlling a bathing system, according to an exemplary embodiment.

As shown in FIG. 8, an exemplary method 800 of controlling a bathing system to maintain a temperature of water in a bathtub includes a first step 801 of receiving, by a controller, a signal from a sensor that indicates a water level of the bathtub. In a second step 802, the method further includes providing, in response to the signal, a flow of air from an air blower to a conduit, wherein the conduit is coupled to an inlet of the bathtub. In a third step 803, the method further includes providing, in response to the signal from the sensor, steam from a steam generator to the conduit to create a mixture of steam and air, wherein the steam generator is fluidly coupled between the inlet and the air blower. In a fourth step 804, the method further includes directing, by the air blower, the mixture of steam and air to the bathtub. The controller is configured to maintain a temperature of a volume of water in the bathtub within a predetermined temperature range based on input from the sensor.

According to one aspect of the method 800, the controller interfaces with at least one valve configured to adjust or regulate a temperature of the volume of the water in the bathtub.

According to a still further aspect of the method 800, the bathtub includes at least one water level sensor interfacing with the controller to send a signal to the steam generator based on a level of water in the bathtub.

According to a still further aspect of the method 800, the air blower is configured to provide a flow of air into the steam generator to purge the steam generator.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like, as used herein, mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the bathing systems or control system as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments.

Other substitutions, modifications, changes and omissions may also be made in the design, operating conditions and arrangement of the various exemplary embodiments without departing from the scope of the present invention. For example, any element (e.g., valve, conduit, etc.) disclosed in one embodiment may be incorporated or utilized with any other embodiment disclosed herein.

What is claimed is:

1. A bathing system, comprising:

a vessel for accommodating a user, the vessel comprising an inlet;

an air blower fluidly coupled to the inlet by a conduit, wherein the air blower is configured to provide a flow of air to the conduit; and a steam generator fluidly coupled to the conduit upstream of the inlet, wherein the steam generator is configured to provide steam to the conduit to combine directly with the flow of air so as to create a mixture of only steam and air in the conduit;

wherein the air blower is further configured to direct the mixture of only steam and air to the inlet.

2. The bathing system according to claim 1, further comprising a connector coupled to the conduit, wherein the connector fluidly couples the steam generator to the air blower upstream of the inlet.

3. The bathing system according to claim 2, wherein the connector is a T-shaped connector.

4. The bathing system according to claim 2, wherein the connector is a Y-shaped connector.

5. The bathing system according to claim 1, further comprising an air source fluidly coupled to the air blower upstream of the air blower, wherein the air source is configured to provide air to the air blower.

6. The bathing system according to claim 1, further comprising a water source fluidly coupled to the steam generator upstream of the steam generator, wherein the water source is configured to provide water to the steam generator.

7. The bathing system according to claim 1, wherein the mixture has an air to steam ratio of between about 1:1 to about 1:50.

8. The bathing system according to claim 1, further comprising at least one sensor disposed in the vessel, wherein the at least one sensor is configured to detect a water level in the vessel.

9. The bathing system according to claim 8, further comprising a controller coupled to the at least one sensor, wherein the controller is configured to control an amount of the mixture provided to the vessel in response to the signal received from the at least one sensor.

10. The bathing system according to claim 9, wherein the controller is further configured to control an amount of air provided to the air blower in response to the signal received from the at least one sensor.

11. The bathing system according to claim 9, wherein the controller is further configured to control an amount of water provided to the steam generator in response to the signal received from the at least one sensor.

12. The bathing system according to claim 1, further comprising a temperature sensor configured to measure a temperature of the mixture.

13. A bathing system, comprising:

a bathtub comprising a vessel for accommodating a user, the vessel comprising an inlet;

an air blower fluidly coupled to the inlet by a conduit, wherein the air blower is configured to provide a flow of air to the conduit; and a steam generator fluidly coupled to the conduit by a connector upstream of the inlet, wherein the steam generator is configured to provide steam to the connector to combine directly with the flow of air so as to create a mixture of only steam and air at the connector;

wherein the air blower is further configured to direct the mixture of only steam and air to the inlet.

14. The bathing system according to claim 13, wherein the connector is one of a T-shaped connector or a Y-shaped connector.

15. The bathing system according to claim 13, further comprising an air source fluidly coupled to the air blower upstream of the air blower, wherein the air source is configured to provide air to the air blower.

16. The bathing system according to claim 13, further comprising a water source fluidly coupled to the steam generator upstream of the steam generator, wherein the water source is configured to provide water to the steam generator.

17. The bathing system according to claim 13, wherein the mixture has an air to steam ratio of between about 1:1 to about 1:50.

18. The bathing system according to claim 13, further comprising at least one sensor disposed in the bathtub, the at least one sensor configured to detect a water level in the bathtub.

19. The bathing system according to claim 18, further comprising a controller coupled to the at least one sensor, wherein the controller is configured to control an amount of the mixture provided to the vessel in response to the signal received from the at least one sensor.

20. A method of controlling a bathing system, comprising:

receiving, by a controller, a signal from a sensor that indicates a water level in a bathtub of the bathing system, the bathtub comprising a vessel for accommodating a user;

providing, in response to the signal, a flow of air from an air blower to a conduit, wherein the conduit is coupled to an inlet of the vessel;

providing, in response to the signal, steam from a steam generator to the conduit to combine directly with the flow of air so as to create a mixture of only steam and air, wherein the steam generator is fluidly coupled to the conduit between the inlet and the air blower; and directing, by the air blower, the mixture of only steam and air to the inlet.

* * * * *